US005979822A

United States Patent [19]

Morand et al.

[11] Patent Number: 5,979,822

[45] Date of Patent: Nov. 9, 1999

[54] APPARATUS FOR DISPENSING SHEET MATERIAL FROM A ROLL OF SHEET MATERIAL

[75] Inventors: Michel Morand, Montreal, Canada; Patrick C. Perrin, Rancho Palos Verdes; Arthur Van De Brake, San Dimas, both of Calif.

[73] Assignee: Perrin Manufacturing Company, City of Industry, Calif.

[21] Appl. No.: 09/164,440

[22] Filed: Sep. 30, 1998

[51] Int. Cl.[6] ..... B65H 16/10

[52] U.S. Cl. ..... 242/564.2; 242/560; 242/596.8; 312/34.19; 312/34.22

[58] Field of Search ..... 242/564.2, 560, 242/564.1, 596.8; 312/34.19, 34.22, 34.8

[56] References Cited

U.S. PATENT DOCUMENTS

| | | | |
|---|---|---|---|
| 1,025,312 | 5/1912 | Rydquist | 242/564.1 |
| 1,026,128 | 5/1912 | Rydquist | 242/564.2 X |
| 1,084,598 | 1/1914 | Antone | 242/564.2 X |
| 1,860,668 | 5/1932 | Gillet | 242/564.2 X |
| 2,169,399 | 8/1939 | Steiner | 242/596.8 X |
| 2,930,664 | 3/1960 | Liebisch | 242/560 |
| 2,957,636 | 10/1960 | Lesavoy | 242/564.2 |
| 3,107,957 | 10/1963 | Batlas et al. | 242/564.2 |
| 3,140,060 | 7/1964 | Layton et al. | 242/564.1 |
| 3,628,743 | 12/1971 | Bastian et al. | 312/34.22 X |
| 3,672,552 | 6/1972 | Krueger et al. | 242/564.2 X |
| 4,192,442 | 3/1980 | Bastian et al. . | |
| 4,699,304 | 10/1987 | Voss et al. | 242/564.2 X |
| 4,756,485 | 7/1988 | Bastian et al. | 312/34.22 X |
| 4,807,824 | 2/1989 | Gains et al. | 312/34.22 X |
| 4,846,412 | 7/1989 | Morand . | |
| 5,294,192 | 3/1994 | Omdoll et al. . | |

FOREIGN PATENT DOCUMENTS

| | | | |
|---|---|---|---|
| 794825 | 5/1958 | United Kingdom | 242/564.1 |
| 1114891 | 5/1968 | United Kingdom | 242/564.1 |

*Primary Examiner*—Donald P. Walsh
*Assistant Examiner*—Minh-Chau Pham
*Attorney, Agent, or Firm*—Thomas R. Lampe

[57] ABSTRACT

Apparatus for dispensing sheet material from a roll of sheet material includes a rotatable sheet material engagement member having a smooth outer surface for engaging the sheet material. A pivoted shaft is mounted adjacent to the sheet material engagement member having a feed roller mounted thereon. The shaft and feed roller are moved toward the sheet material engagement member and the feed roller is rotated to transport the sheet material over the smooth outer surface of the sheet material engagement member. A tucker member is attached to the sheet material engagement member and rotates upon depletion of a primary roll of sheet material to position the lead end of a reserve roll between the sheet material engagement member and the feed roller.

29 Claims, 8 Drawing Sheets

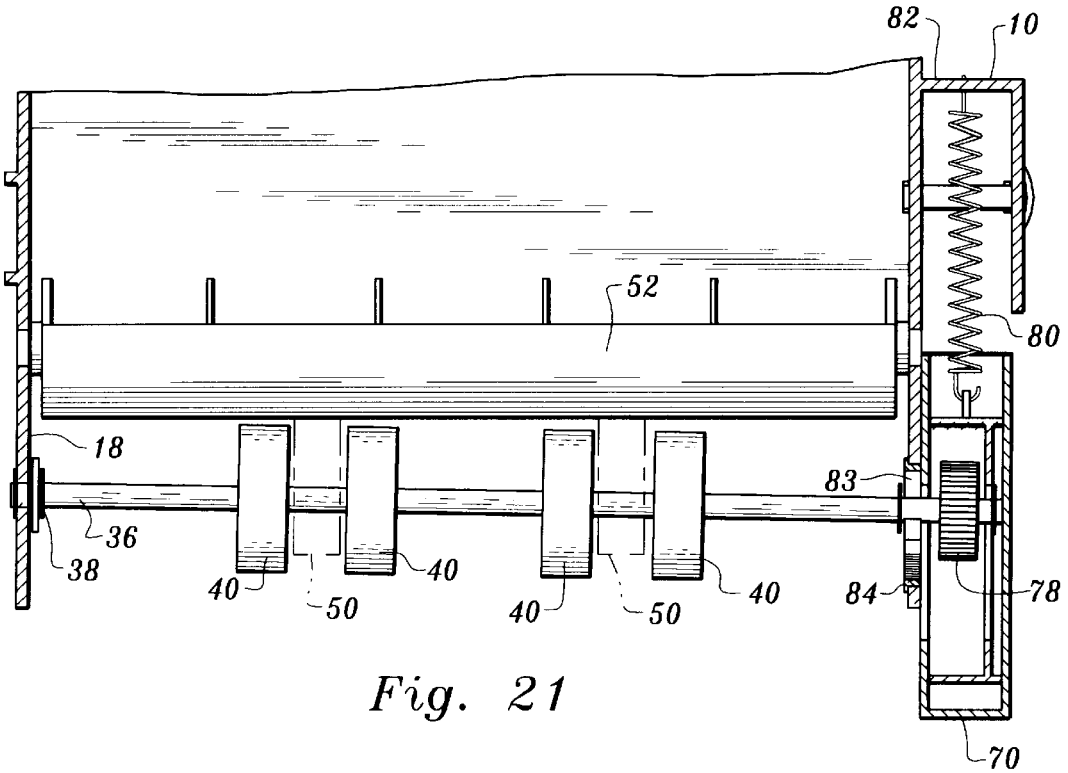
Fig. 21
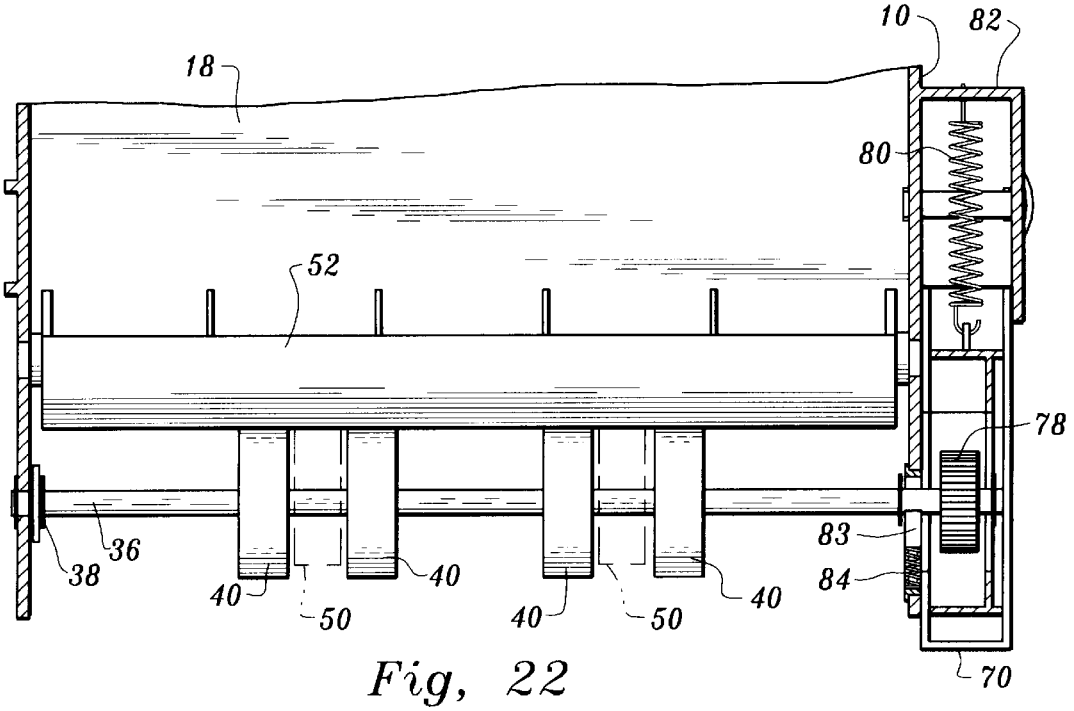
Fig, 22

APPARATUS FOR DISPENSING SHEET MATERIAL FROM A ROLL OF SHEET MATERIAL

TECHNICAL FIELD

This invention relates to apparatus for dispensing sheet material from a roll of sheet material. The invention is particularly applicable to the dispensing of paper toweling.

BACKGROUND OF THE INVENTION

A great many systems have been devised over the years for dispensing paper toweling from rolls thereof. Many of these systems employ rotatable feed rollers which engage the toweling and direct same to a position exterior of a cabinet or housing for delivery to the consumer. A wide variety of mechanisms have been devised to cause and control rotation of the feed roller as well as severance of the individual towel sheets from the toweling unwound from the roll.

With respect to feed roller actuation and rotation, the use of one-way clutch mechanisms is not uncommon, such mechanisms being utilized to ensure rotation of feed rollers in only one direction of rotation upon actuation of the dispenser mechanism by the consumer. The purpose of such mechanism is, of course, to ensure that the feed roller will only operate to feed the toweling out of the housing and not back toward the supply roll. One-way clutches, while effective for their intended purpose, can add considerably to the cost of paper towel dispensers.

U.S. Pat. No. 4,192,442 discloses an approach aimed at elimination of a conventional one-way clutch in the form of a floating or displaceable gear which is operable to disengage the actuator structure from the feed roller structure of a paper towel dispenser after a consumer has caused delivery of a towel to dispensing position. Such an approach, while not as expensive or complicated as conventional one-way clutches, is still more complex than the arrangement disclosed and claimed herein.

Other representative patents in the field are U.S. Pat. No. 4,846,412, issued Jul. 11, 1988 and U.S. Pat. No. 5,294,192, issued Mar. 15, 1994.

DISCLOSURE OF INVENTION

The present invention relates to apparatus which utilizes a relatively inexpensive structural arrangement as a substitute for one-way clutch mechanism to efficiently, reliably and effectively dispense sheet material from a roll of sheet material through use of a rotatable sheet material feed roller. Furthermore, the invention encompasses a unique approach for automatically introducing the lead end of sheet material such as paper toweling into the transport or feed mechanism (including the rotatable feed roller) responsive to depletion of another roll.

The apparatus includes a housing defining an interior for accommodating a roll of sheet material and additionally defining a sheet material outlet communicating with the interior.

Sheet material engagement means is provided for engaging sheet material unwound from a roll of sheet material within the housing interior.

The apparatus also includes sheet material feed means positioned adjacent to the sheet material engagement means including a rotatable sheet material feed roller and a support member supporting the sheet material feed roller.

The support member is pivotally mounted relative to the housing to selectively alternatively move the sheet material feed roller toward or away from the sheet material engagement means.

Means is incorporated in the apparatus for rotating the sheet material feed roller to transport sheet material engaged by the sheet material engagement means toward the sheet material outlet after the sheet material feed roller has moved toward the sheet material engagement means. In the preferred embodiments disclosed herein the sheet material engagement means comprises a rotatable sheet material engagement member having a smoothly curved outer surface.

A tucker member is connected to the rotatable sheet material engagement member, the tucker member responsive to rotational movement of the rotatable sheet material engagement member to move toward a location between the sheet material feed roller and the rotatable sheet material engagement member to tuck the lead end of a roll of sheet material between the sheet material feed roller and the rotatable sheet material engagement member.

Other features, advantages, and objects of the present invention will become apparent with reference to the following description and accompanying drawings.

BRIEF DESCRIPTION OF DRAWINGS

FIG. 21 is an enlarged sectional top view illustrating the feed roller and support shaft of the apparatus pivoted away from the sheet material engagement member as well as associated structure including the actuator lever in non-depressed condition; and FIG. 22 is a view similar to FIG. 21 but illustrating segments of the feed roller of the apparatus in direct engagement with the rotatable sheet material engagement member and the actuator lever depressed.

PREFERRED MODE FOR CARRYING OUT THE INVENTION

Figures 1, 2:
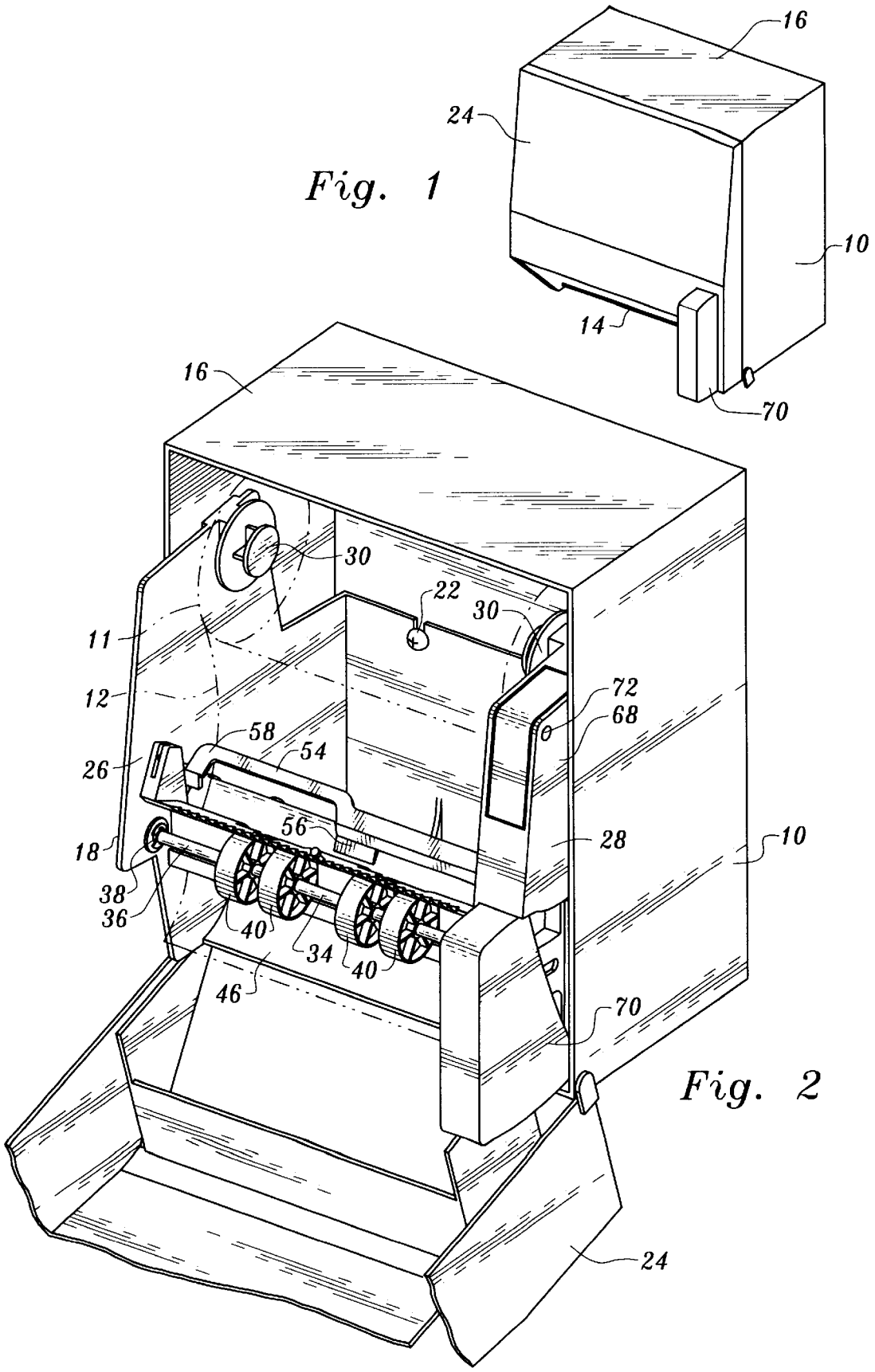
FIG. 1 is a frontal, perspective view of dispenser apparatus incorporating the teachings of the present invention.
FIG. 2 is an enlarged, frontal, perspective view of the apparatus with the front cover of the dispenser opened to show the housing interior and components of the apparatus.

Referring now to the drawings, apparatus constructed in accordance with the teachings of the present invention is illustrated.

The apparatus includes a housing 10 defining an interior for accommodating a roll of sheet material in the form of a roll 11 of paper toweling 12. The housing has an outlet 14 communicating with the housing interior.

Figure 3:
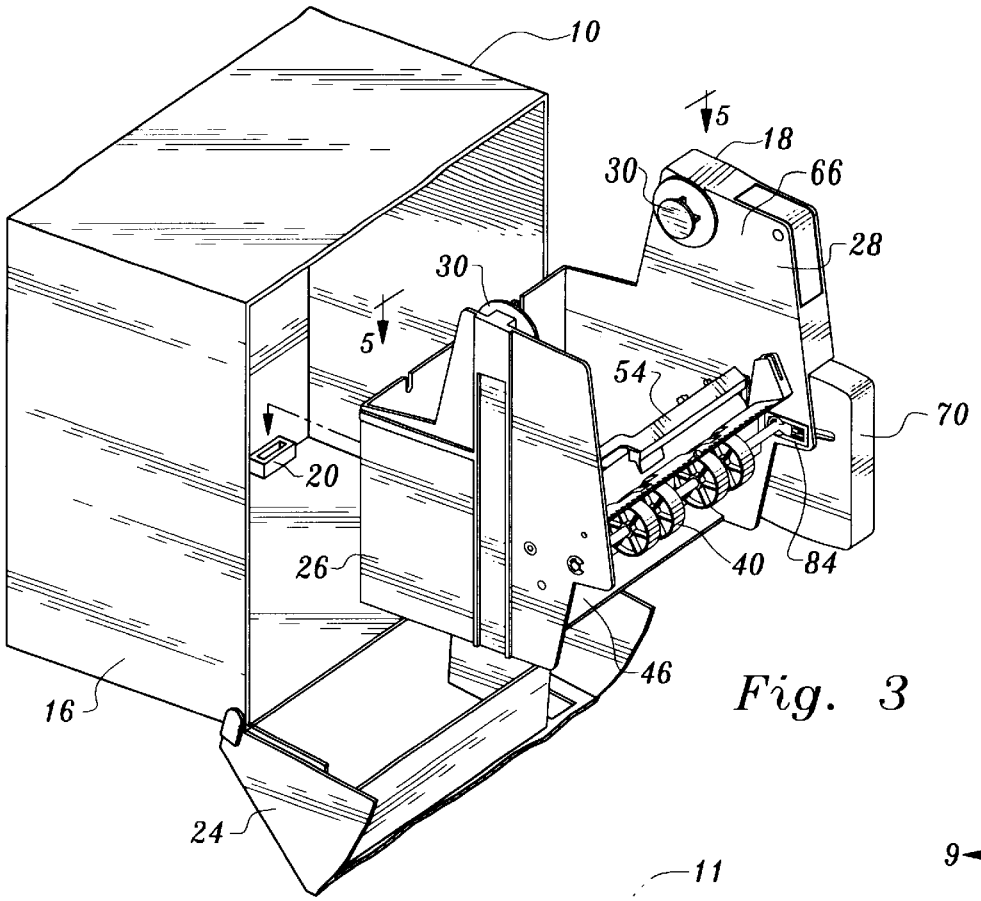
FIG. 3 is an exploded perspective view illustrating an inner housing segment and associated structure being positioned into an outer housing segment of the dispenser apparatus housing.
Figure 4:
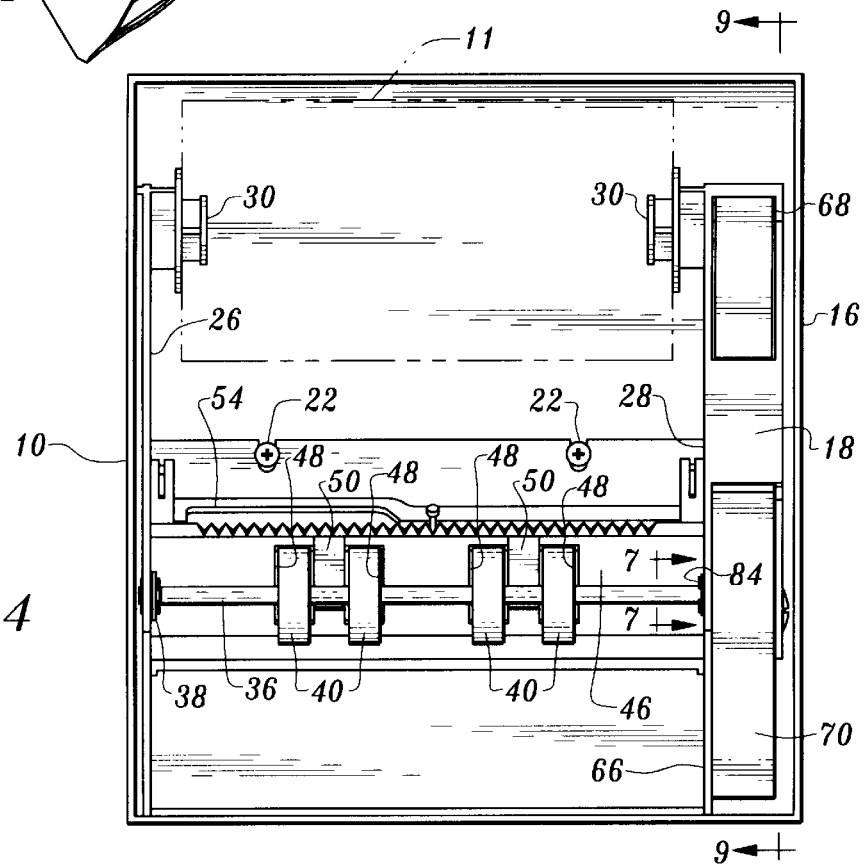
FIG. 4 is a front elevational view of the apparatus as seen through the open front of the housing.
Figure 5:
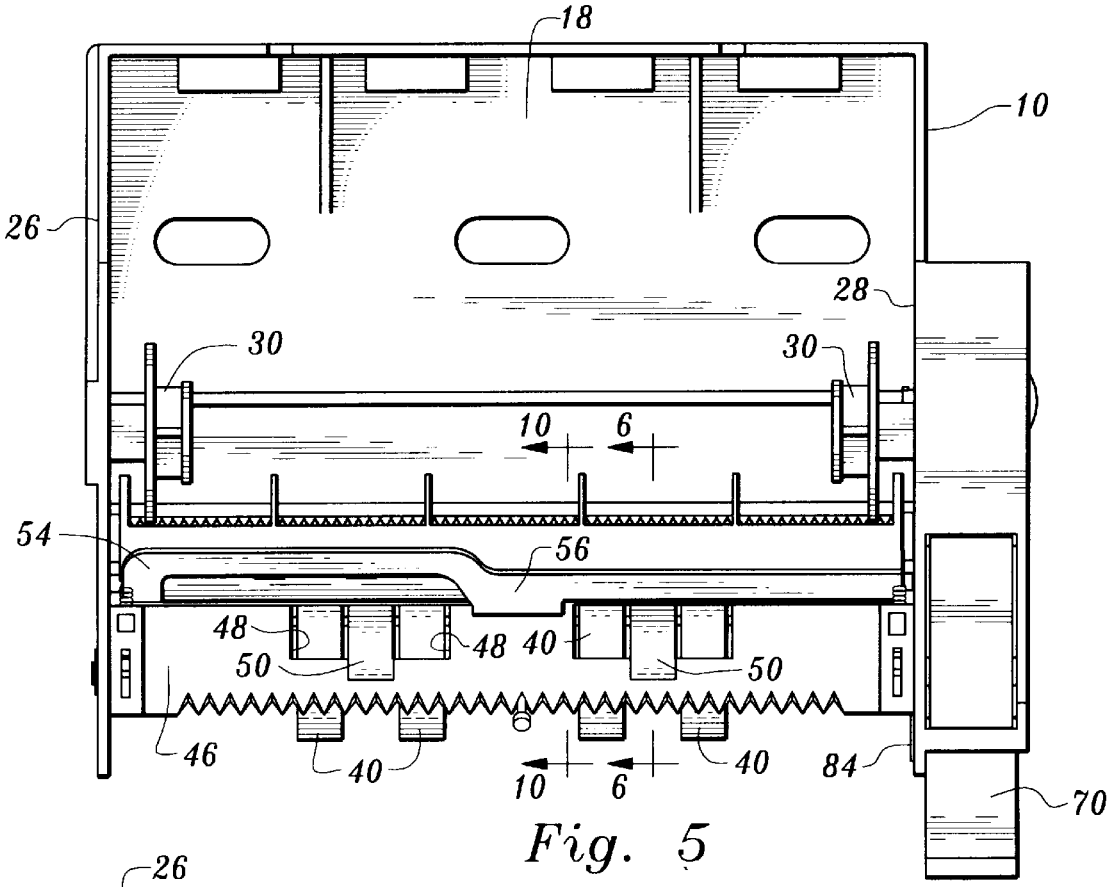
FIG. 5 is an enlarged plan view taken along the line 5—5 in FIG. 3.
Figure 6:
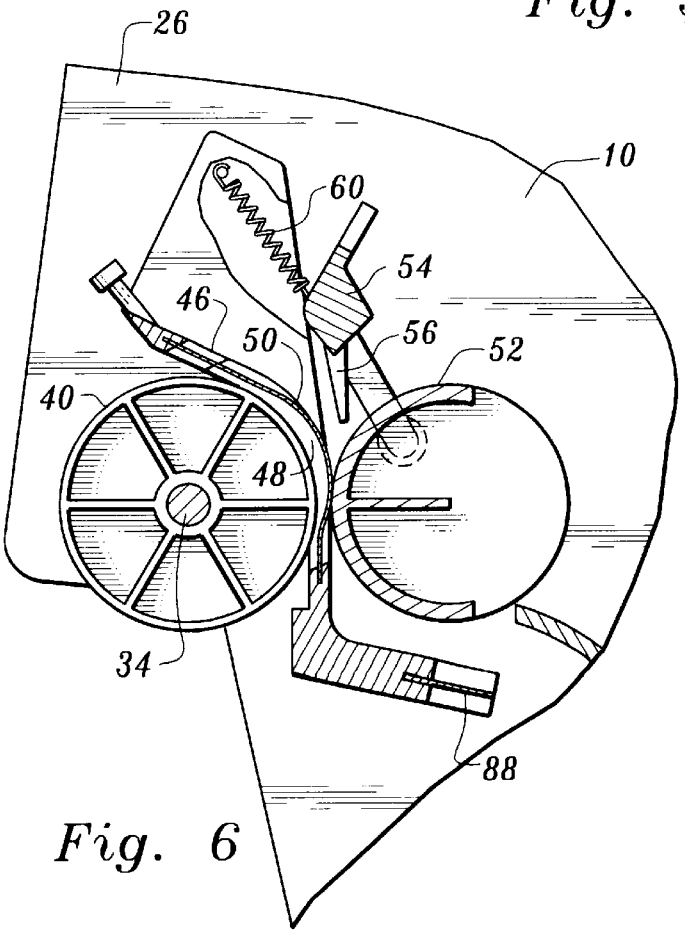
FIG. 6 is an enlarged cross-sectional view of that portion of the apparatus delineated by line 6—6 in FIG. 5.

In the arrangement illustrated, the housing includes an outer housing segment 16 and an inner housing segment 18. These housing segments may be releasably connected together by any suitable means. With particular reference to FIG. 3, the connector employed herein to provide such releasable connection is in the form of a receptacle 20 located on the back wall of outer housing segment 16 for receiving a portion of the inner housing segment and one or more threaded connectors 22. The disclosed arrangement allows ready connection and disconnection of the housing segments. Outer housing segment 16 includes a hingedly mounted cover 24.

Inner housing segment 18 includes side walls 26, 28. Attached to these side walls are projections 30 which are insertable into the ends of a paper towel roll and allow rotation thereof.

An elongated shaft 34 extends between side walls 26, 28, said shaft including an end 36 which is pivotally connected to side wall 26 by a pivoted socket 38 receiving end 36.

Attached to shaft 34 and extending thereabout are spaced sheet material feed roller segments 40. As will be seen below, these feed roller segments are for the purpose of frictionally engaging paper toweling in contact therewith to transport the toweling toward outlet 14. The feed roller segments have outer surfaces which preferably have a relatively high coefficient of friction. For example, the outer peripheral portions of the feed roller segments may be formed from soft rubber or plastic material having a rough, irregular or non-smooth outer surface. In the arrangement illustrated, a curved guide plate 46 is affixed to the inner housing segment adjacent to the feed roller segments defining openings 48 through which the feed roller segments project. Spring members 50 extend downwardly from the guide plate at spaced locations thereon.

A sheet material engagement member 52 is rotatably mounted on the side walls 26, 28 adjacent and generally parallel to shaft 34 and the feed roller segments 40. The curved outer surface of the member 52, which may for example be formed from hard molded plastic material, is smooth and has a coefficient of friction substantially less than that of the feed roller segments.

An elongated tucker element 54 is spaced from sheet material engagement member 52 and extends therealong substantially parallel to the rotational axis of the member 52. Tucker element 54 includes a downwardly projecting tucker portion 56 and terminates at two legs 58 which extend alongside the ends of member 52. Legs 58 are affixed to the ends of rotatable member 52 by any suitable expedient. Thus, when the member 52 rotates the entire tucker member comprising tucker element 54, tucker portion 56 and legs 58 will rotate therewith. Member 52 is essentially freely rotatably mounted on side walls 26, 28. Biasing means is provided however to resist rotational movement of member 52 and the tucker member. More particularly, the biasing means is in the form of a tension spring 60 extending from the elongated tucker element 54 to a side wall of the inner housing segment.

Side wall 28 includes two spaced wall panels 66, 68 defining a chamber within which is located a pivotally mounted manually actuatable member in the form of a push lever 70. A portion of the push lever 70 extends forwardly and is engageable by a consumer using the dispenser apparatus. Push lever 70 is pivotal about a support 72 extending between the wall panels 66, 68. A slot 74 is formed in the push lever and the upper end of the slot is defined by a toothed rack 76. Elongated shaft 34 projects through the slot 74. A pinion 78 is affixed to the distal end of the shaft between the wall panels, the pinion engaging the teeth of toothed rack 76.

Figure 11:
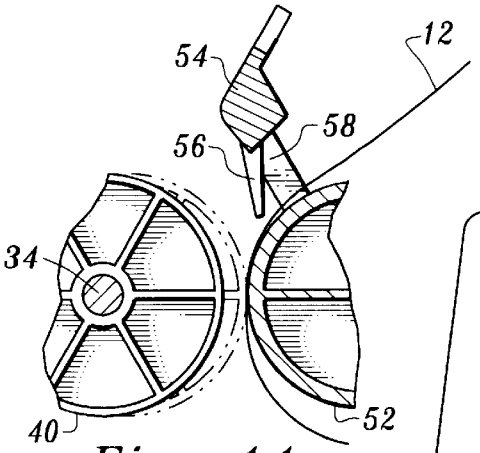
FIG. 11 is an enlarged diagrammatic view illustrating portions of the rollers as depicted in FIG. 10 and their relationship with sheet material and a tucker member.

A tension spring 80 extends between push lever 70 and a panel 82 of side wall 28. Spring 80 continuously urges the push lever 70 to the position shown in FIG. 9. When the push lever has been depressed and the spring 80 returns the push lever to the position of rest shown in FIG. 9 the shaft 34 and pinion 78 are temporarily displaced toward the front of the housing to a certain extent so that the feed roller segments 40 are withdrawn from contact with sheet material engagement member 52 for a short period of time. This condition can be seen in the solid line depictions of the shaft, pinion and roller in FIGS. 9 and 11 and also in FIGS. 6, 10, 15, 16, 19, 20 and 21. However, these elements almost immediately return to the positions illustrated in phantom line in FIGS. 9 and 11 and in solid lines in FIGS. 13, 14, 17, 18 and 22, for example.

Figure 7:
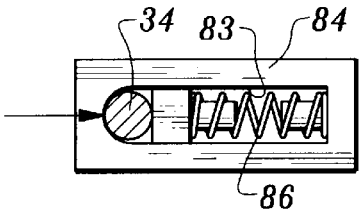
FIG. 7 is a greatly enlarged cross-sectional view showing details of structure employed to bias a pivoted feed roller support shaft employed in the apparatus, as taken along line 7—7 in FIG. 4.
Figure 8:
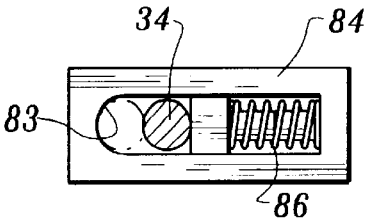
FIG. 8 is a view similar to FIG. 7 but illustrating structural components in different relative positions.
Figure 10:
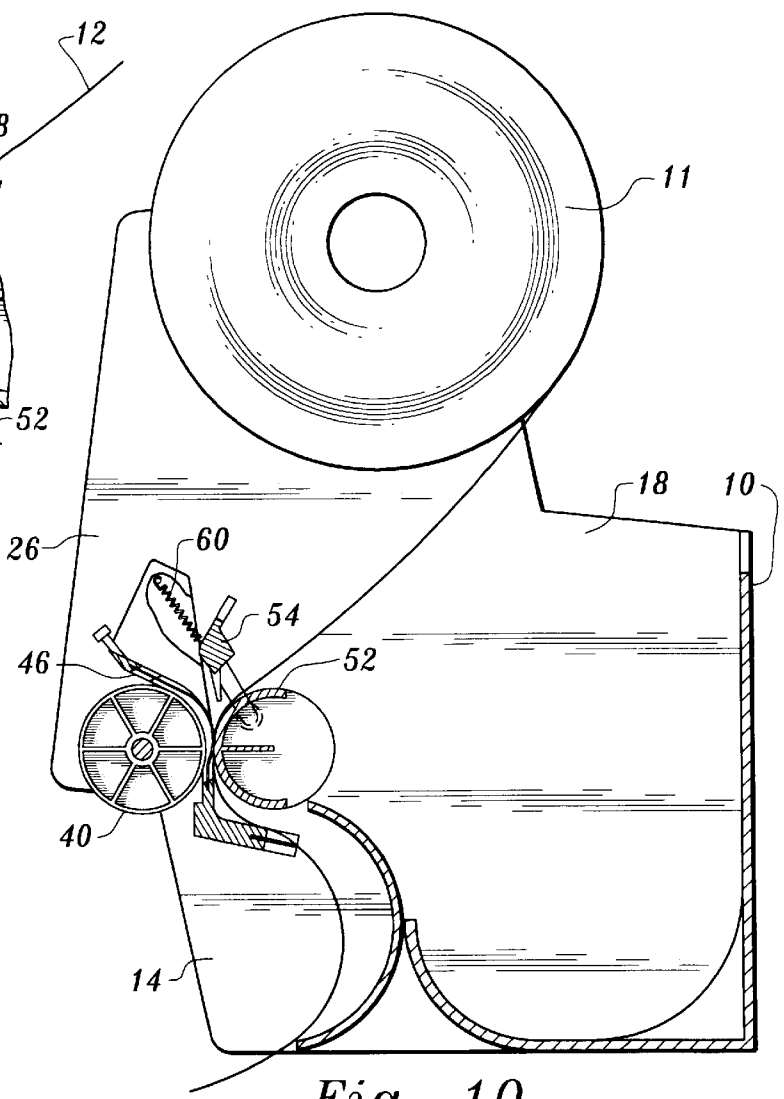
FIG. 10 is a sectional view taken along line 10—10 in FIG. 5 and illustrating in solid lines the relative positions assumed by the feed roller and sheet material engagement member of the apparatus when sheet material is disposed therebetween and the actuator lever has just returned from being depressed by the user to the position shown in FIG. 9.

With particular reference to FIGS. 5, 7, 8, 21 and 22, the distal or free end of shaft 34 passes through a guide slot 83 of an enclosure 84 attached to side wall 28. A compression spring 86 in enclosure 84 continuously biases the shaft 34 and roller segments toward member 52 and immediately after the actuator lever has been depressed and returns to rest position, spring 86 returns the roller segments into contact with member 52 with shaft 34 again parallel to the rotational axis of member 52. This latter shaft position is shown in FIG. 7 in solid line and in FIG. 8 in phantom line.

Spring members 50 engage any toweling on member 52 at all times to prevent shifting and possible jamming thereof resulting from momentary displacement of roller segments 40 from the toweling. The length of slot 83 limits pivotal movement of the shaft and thus limits and controls nip pressure between feed roller segments 40 and member 52. The pinion 78 is maintained in contact with the teeth of toothed rack 76 by virtue of the fact that shaft 34 rides in slot 83. Slot 83 limits the degree of pivotal movement of the shaft and thus also the feed roller segments.

Figure 12:
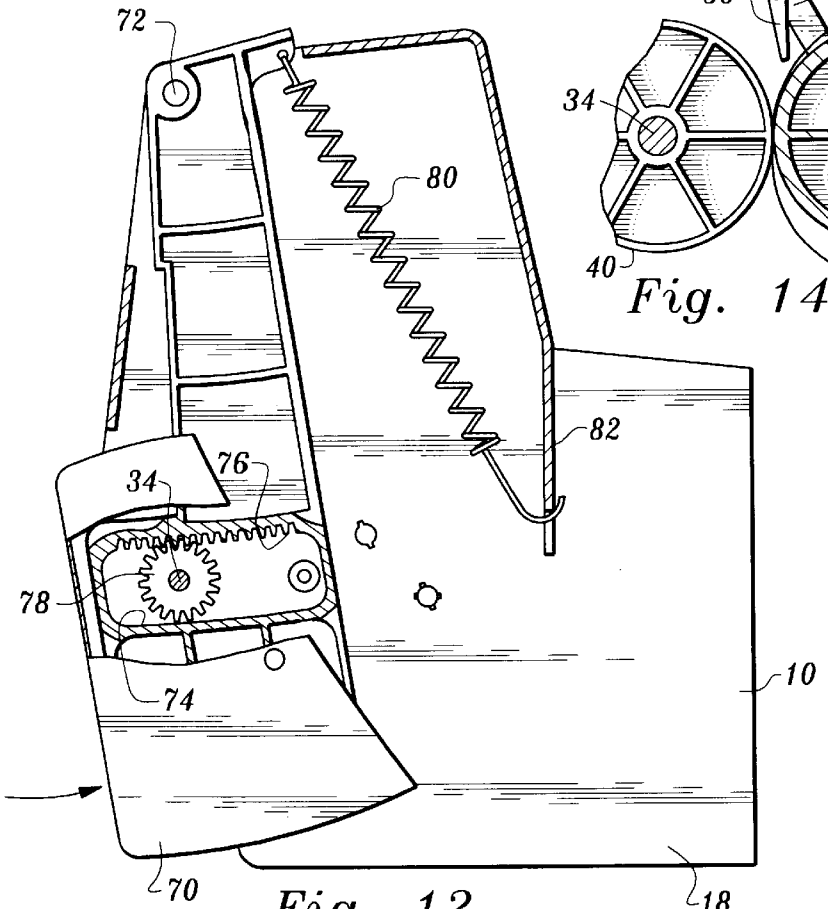
FIG. 12 is a view similar to FIG. 9 but illustrating the actuator lever being depressed.

FIG. 12 illustrates the push lever 70 being depressed in the direction of the illustrated arrow. This will result in rotation of shaft 34 and the feed roller segments due to the cooperation of the pinion 78 and rack 76.

Figure 13:
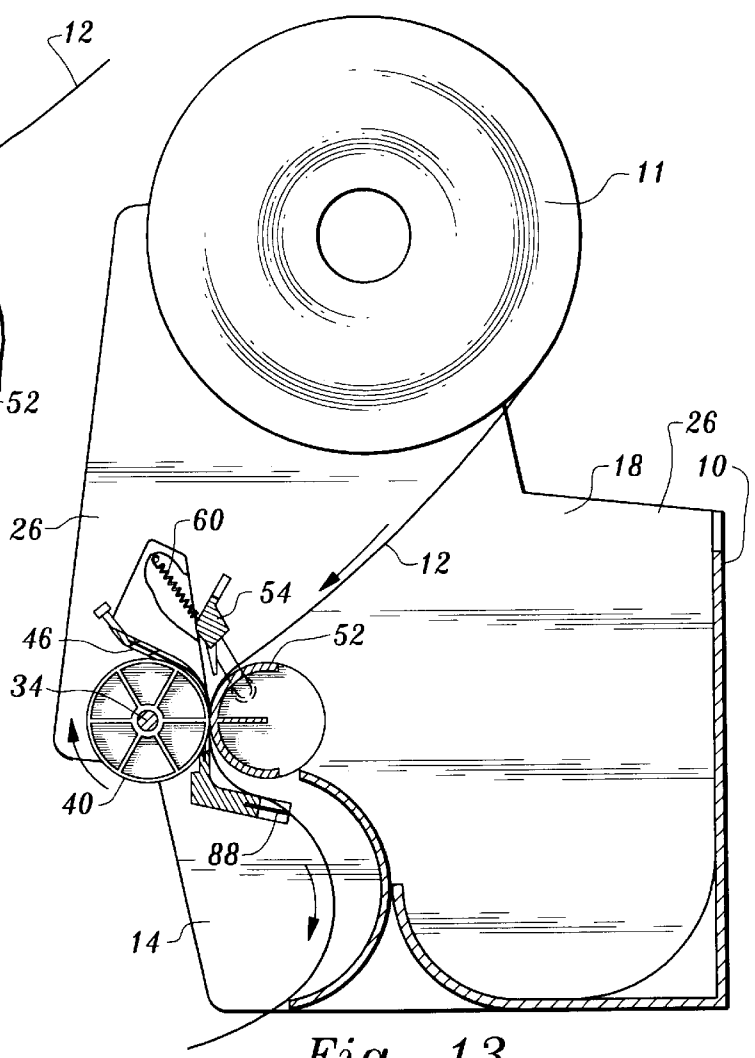
FIGS. 13 and 14 are views similar to those depicted in FIGS. 10 and 11 but showing the positions assumed by the illustrated components when the actuator lever is depressed as shown in FIG. 12.
Figure 14:
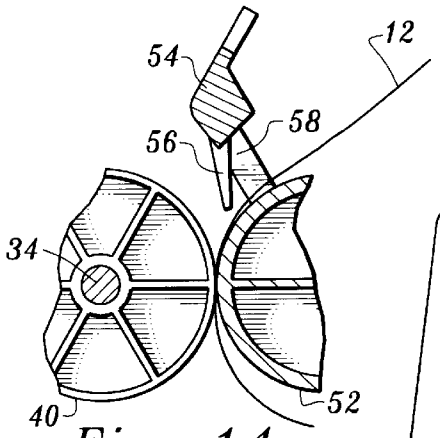

In FIGS. 13 and 14 paper toweling 12 has been prepositioned between the sheet material engagement member 52 and the feed roller segments 40 so the paper toweling is pinched in a nip formed between the member 52 and the feed roller segments. Rotation of the shaft and feed roller segments will cause the paper toweling to move downwardly through the nip and be unwound from the roll 11 as indicated by the arrow in FIG. 13. This is due to the fact that a higher coefficient of friction exists at the outer peripheral surface of the feed roller segments than at the outer surface of member 52. The feed roller segments will frictionally engage and transport the toweling while the toweling slides along the smooth outer curved surface of non-rotating member 52. As previously indicated, rotation of member 52 is resisted by tension spring 60. After the feed roller segments have caused transport of paper toweling toward the outlet 14 a consumer can grasp the free end of the toweling and manipulate the toweling to sever a length thereof along serrated blade 88 fixedly mounted in the housing.

Figure 9:
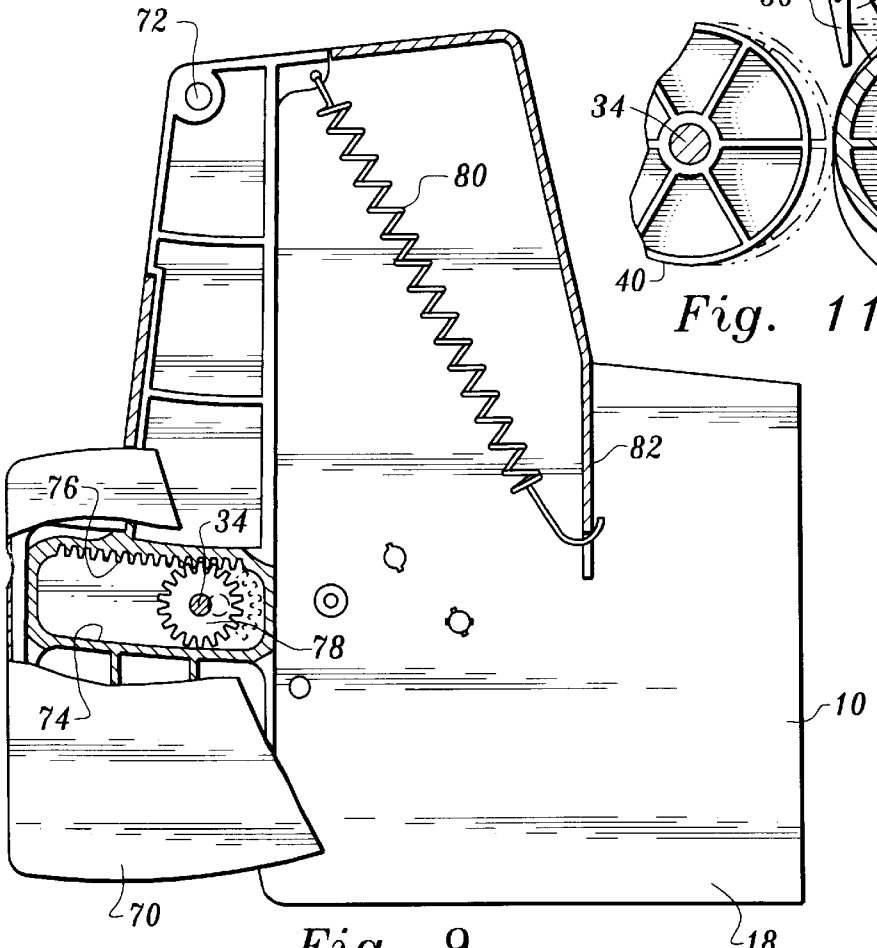
FIG. 9 is an enlarged sectional view illustrating a portion of the apparatus delineated by section line 9—9 in FIG. 4 and illustrating the actuator lever of the apparatus in a non-depressed position.

After the consumer stops pushing against push lever 70, the push lever will return to the position illustrated in FIG. 9. Return movement of the push lever to its non-depressed state will cause the distal end of the shaft (the end having the pinion 78 attached thereto) to move away from member 52. The feed roller segments will also temporarily move away from member 52 as previously described.

Figure 15:
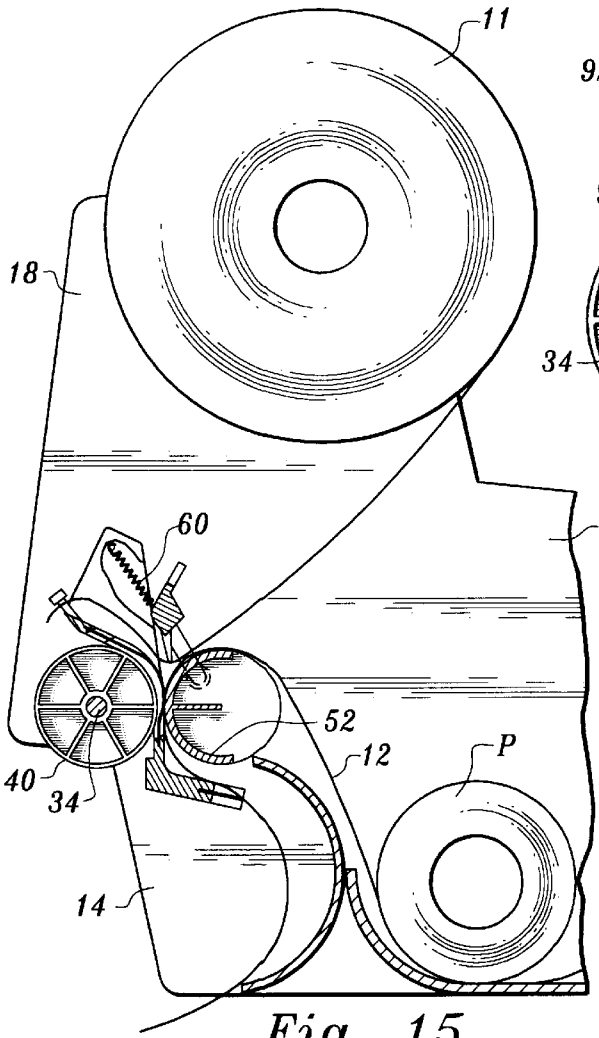
FIG. 15 is a sectional side view similar to FIG. 10 but illustrating both primary and reserve rolls of paper toweling in position and the relationship thereof to related structure of the apparatus before depletion of the primary roll.

The apparatus of the present invention incorporates structural components which cooperate to provide for the automatic transfer to a reserve roll of paper toweling upon depletion of a primary roll of paper toweling. In FIG. 15, a partially depleted primary roll of toweling P has been repositioned by an attendant into a well or recess located at the bottom of the housing and a full reserve roll 11 has been placed between the projections 30.

Toweling 12 from the reserve roll is placed over sheet material engagement member 52, under tucker element 54 and over the end of an auxiliary blade 90 attached to guide plate 46 which can be used to square off the toweling end. Toweling 12 from the reserve roll is kept out of engagement with the feed roller segments by inpaling the free end of the toweling on a projection 92 affixed to the blade 90.

Figure 17:
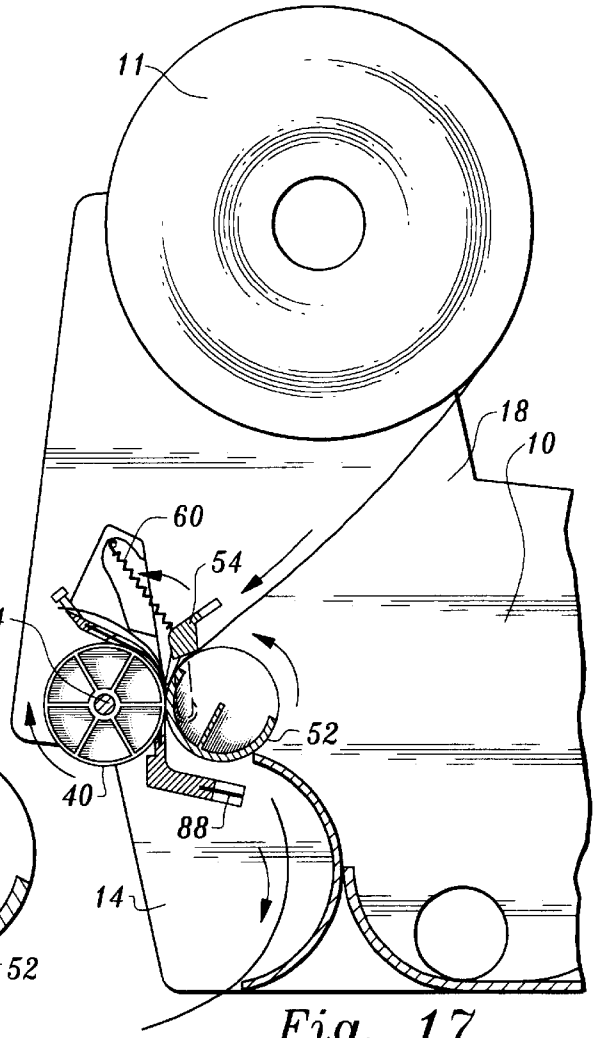
FIG. 17 illustrates the relative positions and cooperable relationships of the structural components shown when transfer to a reserve roll from a depleted primary roll is being initiated due to depression of the actuator lever and movement of the tucker member.
Figure 16:
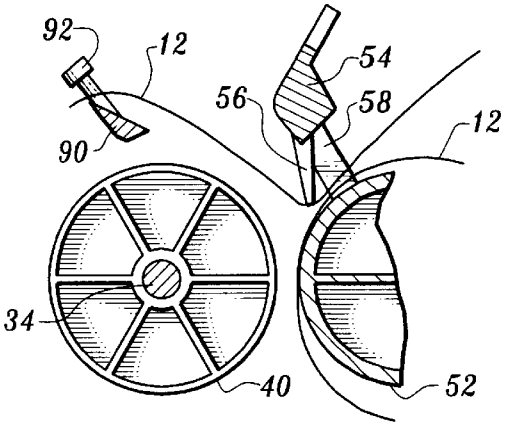
FIG. 16 is a view similar to FIG. 11 but showing toweling from both the primary and reserve rolls and positions thereof relative to the feed roller, sheet material engagement member and tucker member of the apparatus when the actuator lever has just return from being depressed by the user.
Figure 18:
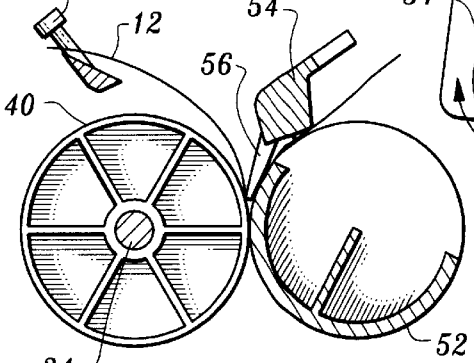
FIG. 18 is a view similar to FIG. 16 but illustrating the situation after depletion of the primary roll and movement of the tucker member responsive to engagement between the feed roller and sheet material engagement member upon depression of the actuator lever.

As soon as the tail end of the toweling from roll P passes between the nip formed by member 52 and feed roller segments 40 the feed roller segments will be placed into direct contact with member 52. This engagement will cause member 52 to rotate with the feed roller segments as shown in FIG. 17 against the urging of spring 60. This will cause the elongated tucker element 54 to rotate downwardly toward a location wherein the tucker portion 56 is between the member 52 and the feed roller segments. This is shown in FIG. 18.

Figure 19:
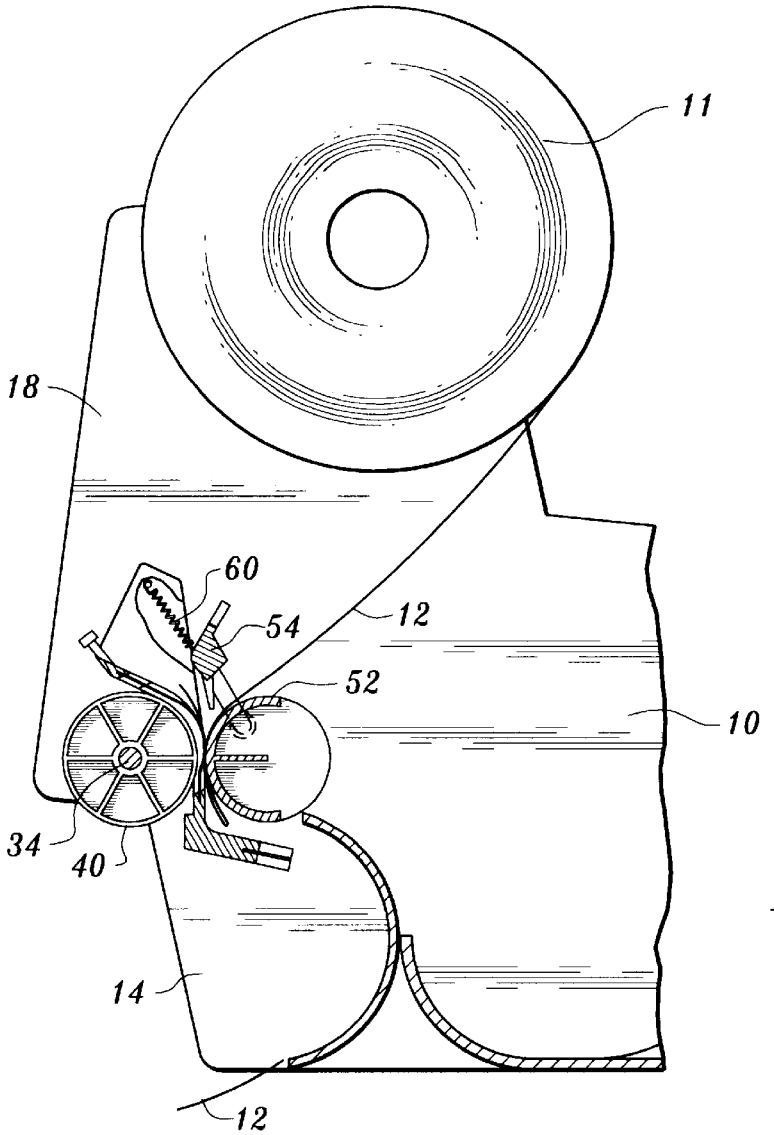
FIGS. 19 and 20 illustrate the conditions of the illustrated apparatus components and associated lead end of the reserve roll after transfer from the depleted primary roll has taken place.
Figure 20:
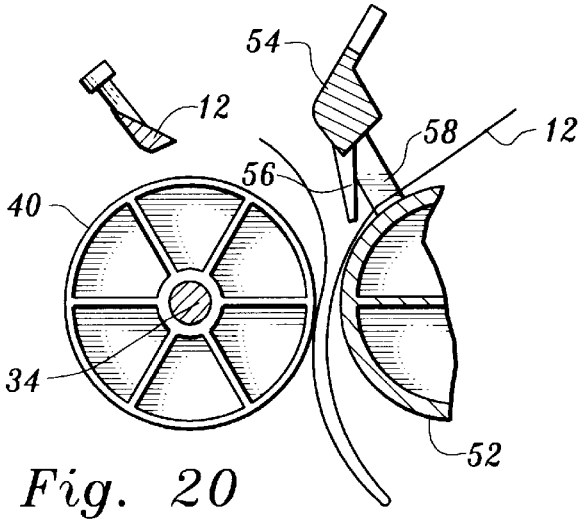

The lead end of the toweling from the reserve roll is torn from projection 92 and wedged in position between the feed roller segments 40 and the member 52 by the tucker mechanism and will remain in position therebetween after the push lever and tucker element return to their initial positions. This situation is shown in FIGS. 19 and 20. Renewed depression of the push lever 70 will then cause dispensing from the new or reserve roll.

We claim:

1. Apparatus for dispensing sheet material from a roll of sheet material, said apparatus comprising, in combination:

a housing defining an interior for accommodating a roll of sheet material and additionally defining a sheet material outlet communicating with said interior;

sheet material engagement means for engaging sheet material unwound from a roll of sheet material within the housing interior, said sheet material engagement means extending in a direction transverse to the direction of movement of said sheet material as said sheet material is being unwound from the roll of sheet material;

sheet material feed means positioned adjacent to said sheet material engagement means including a rotatable sheet material feed roller and a support member comprising a double-ended shaft supporting said sheet material feed roller, said double-ended shaft being disposed adjacent to and extending alongside said sheet material engagement means;

shaft support means supporting one of the ends of said double-ended shaft and allowing pivotal movement of said double-ended shaft relative to said shaft support means and movement of the other end of said double-ended shaft and said sheet material feed roller alternatively either toward or away from said sheet material engagement means; and means including movable actuator means for rotating said sheet material feed roller to transport sheet material engaged by said sheet material engagement means and by said sheet material feed roller toward said sheet material outlet after pivotal movement of said double-ended shaft and after said other end of said double-ended shaft and sheet material feed roller have moved toward said sheet material engagement means and said sheet material feed roller and said sheet material engagement means exert pressure on said sheet material, pivotal movement of said double-ended shaft being responsive to movement of said movable actuator means.

2. The apparatus according to claim 1 wherein said sheet material engagement means comprises a rotatable sheet material engagement member.

3. The apparatus according to claim 2 additionally comprising a tucker member connected to said rotatable sheet material engagement member, said tucker member responsive to rotational movement of said rotatable sheet material engagement member to move toward a location between said sheet material feed roller and said rotatable sheet material engagement member to tuck the lead end of a roll of sheet material between said sheet material feed roller and said rotatable sheet material engagement member.

4. The apparatus according to claim 2 wherein said rotatable sheet material engagement member has an outer surface.

5. The apparatus according to claim 4 wherein said sheet material feed roller has an outer feed roller surface having a coefficient of friction greater than the coefficient of friction of the outer surface of said rotatable sheet material engagement member.

6. The apparatus according to claim 1 wherein said housing includes opposed side walls, and wherein said shaft support means is located at one of said side walls.

7. The apparatus according to claim 6 wherein said other end of said double-ended shaft is connected to said means for rotating said sheet material feed roller and movable therewith.

8. The apparatus according to claim 7 wherein said means for rotating said sheet material feed roller includes a movable manually actuatable member and transmission means interconnecting said movable manually actuatable member and said double-ended shaft and responsive to movement of said movable manually actuatable member to rotate said double-ended shaft and said sheet material feed roller, pivot said double-ended shaft, and move said sheet material feed roller toward said sheet material engagement means.

9. The apparatus according to claim 8 wherein said transmission means includes a toothed rack connected to said movable manually actuatable member and a pinion attached to said other end of said double-ended shaft engaging said toothed rack and rotatable in response to movement of said toothed rack.

10. The apparatus according to claim 8 wherein said movable manually actuatable member is movable between two positions, said apparatus additionally comprising means continuously biasing said movable manually actuatable member to one of said positions.

11. The apparatus according to claim 8 additionally comprising shaft biasing means located at said other end of said double-ended shaft for biasing said double-ended shaft toward said sheet material engagement means.

12. The apparatus according to claim 1 wherein said housing includes an outer housing segment and an inner housing segment releasably connected to said outer housing segment and selectively removable therefrom, said support member being pivotally connected to said inner housing segment.

13. The apparatus according to claim 1 wherein said sheet material feed roller comprises a plurality of spaced sheet material feed roller segments.

14. The apparatus according to claim 13 additionally comprising at least one spring member located adjacent to at least one of said sheet material feed roller segments to engage and exert a bias against sheet material engaged by said sheet material engagement means.

15. The apparatus according to claim 1 wherein said housing comprises an outer housing segment, an inner housing segment and connector means for releasably connecting said inner and outer housing segments, said sheet material engagement means, said sheet material feed means and said means for rotating said sheet material feed roller all being connected to said inner housing segment and removable therewith as a module from said outer housing segment.

16. The apparatus according to claim 1 including means for limiting pivotal movement of said support member.

17. Apparatus for dispensing sheet material from a roll of sheet material, said apparatus comprising, in combination:

a housing defining an interior for accommodating a roll of sheet material and additionally defining a sheet material outlet communicating with said interior;

sheet material engagement means having an outer surface for engaging sheet material unwound from a roll of sheet material within the housing interior;

rotatable sheet material feed roller means having an outer feed roller surface with a coefficient of friction greater than that of the outer surface of said sheet material engagement means located adjacent to said sheet material engagement means;

a double-ended shaft having first and second ends and supporting said sheet material feed roller means, said double-ended shaft being pivotally mounted relative to said housing to pivot said double-ended shaft about the first end thereof to selectively alternatively move said sheet material feed roller means and the second end of said double-ended shaft toward or away from said sheet material engagement means; and means for rotating said sheet material feed roller means to transport sheet material engaged by said sheet material feed roller means and said sheet material engagement means toward said sheet material outlet after said double-ended shaft has been pivoted about the first end thereof to move the second end thereof and said sheet material feed roller means toward said sheet material engagement means and exert pressure on said sheet material.

18. The apparatus according to claim 17 wherein said sheet material engagement means comprises a rotatable sheet material engagement member, said outer surface being curved.

19. The apparatus according to claim 18 additionally comprising a tucker member connected to said rotatable sheet material engagement member and responsive to rotational movement of said rotatable sheet material engagement member to move toward a location between said sheet material feed roller means and said rotatable sheet material engagement member to tuck the lead end of a roll of sheet material between said sheet material feed roller means and said rotatable sheet material engagement member.

20. Apparatus for dispensing sheet material from a roll of sheet material, said apparatus comprising, in combination:

a housing defining an interior for accommodating a roll of sheet material and additionally defining a sheet material outlet communicating with said interior;

sheet material engagement means comprising a rotatable sheet material engagement member for engaging sheet material unwound from a roll of sheet material within the housing interior;

sheet material feed means positioned adjacent to said rotatable sheet material engagement member including a rotatable sheet material feed roller and a support member supporting said sheet material feed roller, said support member being pivotally mounted relative to said housing to selectively alternatively move said sheet material feed roller toward or away from said rotatable sheet material engagement member;

means for rotating said sheet material feed roller to transport sheet material engaged by said rotatable sheet material engagement member and by said sheet material feed roller toward said sheet material outlet after said sheet material feed roller has moved toward said rotatable sheet material engagement member; and a tucker member connected to said rotatable sheet material engagement member, said tucker member responsive to rotational movement of said rotatable sheet material engagement member to move toward a location between said sheet material feed roller and said rotatable sheet material engagement member to tuck the lead end of a roll of sheet material between said sheet material feed roller and said rotatable sheet material engagement member.

21. The apparatus according to claim 20 including biasing means continuously biasing said tucker member in a direction away from said location.

22. The apparatus according to claim 20 wherein said tucker member is affixed to said rotatable sheet material engagement member for rotatable movement with said rotatable sheet material engagement member, said apparatus including biasing means for biasing said tucker member and said rotatable sheet material engagement member against rotational movement.

23. The apparatus according to claim 20 wherein said tucker member includes an elongated tucker element spaced from said rotatable sheet material engagement member and extending generally parallel to the rotational axis of said rotatable sheet material engagement member.

24. The apparatus according to claim 20 wherein said rotatable sheet material engagement member has a curved outer roller surface directly engageable by said sheet material feed roller to cause rotation of said rotatable sheet material engagement member and movement of said tucker member toward said location responsive to rotation of said sheet material feed roller after the tail end of a roll of sheet material has passed between said sheet material feed roller and said rotatable sheet material engagement member.

25. Apparatus for dispensing sheet material from a roll of sheet material, said apparatus comprising, in combination:

a housing defining an interior for accommodating a primary roll of sheet material having a tail end and a reserve roll of sheet material having a lead end;

rotatable sheet material engagement means;

rotatable sheet material feed means mounted for movement toward and away from said rotatable sheet material engagement means;

a tucker member operatively associated with said rotatable sheet material engagement means;

means for rotating said rotatable sheet material feed means and for moving said rotatable sheet material feed means toward said rotatable sheet material engagement means, said rotatable sheet material engagement means rotating in response to rotation of said rotatable sheet material feed means and passage of the tail end of a primary roll of sheet material between said rotatable sheet material feed means and said rotatable sheet material engagement means and causing movement of said tucker member to tuck the lead end of a reserve roll of sheet material between said rotatable sheet material feed means and said rotatable sheet material engagement means; and biasing means biasing said rotatable sheet material engagement means against rotation.

26. The apparatus according to claim 25 wherein said rotatable sheet material engagement means has an outer surface directly engageable by said rotatable sheet material feed means to rotate said rotatable sheet material engagement means responsive to rotation of said rotatable sheet material feed means.

27. The apparatus according to claim 25 additionally including means mounting said rotatable sheet material feed means for pivotal movement relative to said housing.

28. Apparatus for dispensing sheet material from a roll of sheet material, said apparatus comprising, in combination:

a housing defining an interior for accommodating a primary roll of sheet material having a tail end and a reserve roll of sheet material having a lead end;

a rotatable sheet material engagement member;

rotatable sheet material feed roller means mounted for movement toward and away from said rotatable sheet material engagement member;

a tucker member operatively associated with said rotatable sheet material engagement member; and means for rotating said rotatable sheet material feed roller means and for moving said rotatable sheet material feed roller means toward said rotatable sheet material engagement member, said rotatable sheet material engagement member rotating in response to rotation of said rotatable sheet material feed roller means and passage of the tail end of a primary roll of sheet material between said rotatable sheet material feed roller means and said rotatable sheet material engagement member and causing movement of said tucker member to tuck the lead end of a reserve roll of sheet material between said rotatable sheet material feed roller means and said rotatable sheet material engagement member, said tucker member being connected to said rotatable sheet material engagement member and rotatable therewith.

29. Apparatus for dispensing sheet material from a roll of sheet material, said apparatus comprising, in combination:

a housing defining an interior for accommodating a roll of sheet material and additionally defining a sheet material outlet communicating within said interior;

sheet material engagement means having an outer surface for engaging sheet material unwound from a roll of sheet material within the housing interior;

rotatable sheet material feed roller means having an outer feed roller surface with a coefficient of friction greater than that of the outer surface of said sheet material engagement means located adjacent to said sheet material engagement means double-ended shaft means supporting said sheet material feed roller means, said shaft means being pivotally mounted relative to said housing to selectively alternatively move said sheet material feed roller means toward or away from said sheet material engagement means;

means for rotating said sheet material feed roller means to transport sheet material engaged by said sheet material feed roller means and said sheet material engagement means toward said sheet material outlet after said double-ended shaft means has been pivoted to move said sheet material feed roller means toward said sheet material engagement means, said sheet material engagement means comprising a rotatable sheet material engagement member and said outer surface being curved; and a tucker member connected to said rotatable sheet material engagement member and responsive to rotational movement of said rotatable sheet material engagement member to move toward a location between said sheet material feed roller means and said rotatable sheet material engagement member to tuck the lead end of a roll of sheet material between said sheet material feed roller means and said rotatable sheet material engagement member.

* * * * *